US007598918B2

(12) United States Patent
Durham et al.

(10) Patent No.: US 7,598,918 B2
(45) **Date of Patent: *Oct. 6, 2009**

(54) TUBULAR ENDFIRE SLOT-MODE ANTENNA ARRAY WITH INTER-ELEMENT COUPLING AND ASSOCIATED METHODS

(75) Inventors: Timothy E. Durham, Melbourne, FL (US); Griffin K. Gothard, Satellite Beach, FL (US); Anthony Mark Jones, Palm Bay, FL (US); Jay Kralovec, Viera, FL (US); Stephen R. Landers, Satellite Beach, FL (US); Sean Ortiz, West Melbourne, FL (US); Chris Snyder, Melbourne, FL (US); Ralph Trosa, Indialantic, FL (US)

(73) Assignee: Harris Corporation, Melbourne, FL (US)

( * ) Notice: Subject to any disclaimer, the term of this patent is extended or adjusted under 35 U.S.C. 154(b) by 16 days.

This patent is subject to a terminal disclaimer.

(21) Appl. No.: 12/017,183

(22) Filed: Jan. 21, 2008

(65) Prior Publication Data

US 2008/0150820 A1 Jun. 26, 2008

Related U.S. Application Data

(63) Continuation-in-part of application No. 11/303,338, filed on Dec. 16, 2005, now Pat. No. 7,420,519.

(51) Int. Cl.
*H01Q 13/10* (2006.01)

(52) U.S. Cl. ..... 343/770; 343/700 MS

(58) Field of Classification Search ..... 343/700 MS, 343/909, 767, 770, 853
See application file for complete search history.

(56) References Cited

U.S. PATENT DOCUMENTS

| | | | | |
|---|---|---|---|---|
| 3,221,331 | A | 11/1965 | Spitz | 343/785 |
| 3,293,645 | A | 12/1966 | Farley et al. | 343/708 |
| 3,568,204 | A | 3/1971 | Blaisdell | 343/725 |
| 3,594,810 | A | 7/1971 | Kaloi | 343/848 |
| 3,995,277 | A | 11/1976 | Olyphant, Jr. | 343/846 |

(Continued)

FOREIGN PATENT DOCUMENTS

WO WO03/003510 1/2003

OTHER PUBLICATIONS

"Electrically Small Supergain Endfire Arrays", Yaghjian et al., Aug. 15, 2007 available at http://arxiv.org/PS_cache/arxiv/pdf/0708/0708.1988v1.pdf.

*Primary Examiner*—HoangAnh T Le
(74) *Attorney, Agent, or Firm*—Allen, Dyer, Doppelt, Milbrath & Gilchrist, P.A.

(57) ABSTRACT

The tubular slot-mode antenna includes an array of slot antenna units carried by a tubular substrate, e.g. a cylindrical substrate, and each slot antenna unit having a pair of patch antenna elements arranged in laterally spaced apart relation about at least one central feed position. Adjacent patch antenna elements of adjacent slot-mode antenna units have respective spaced apart edge portions with predetermined shapes and relative positioning to provide increased capacitive coupling therebetween. The array of slot-mode antenna units may define a plurality of ring-shaped slots coaxial with an axis of the tubular substrate, and a feed arrangement may be coupled thereto to operate the array of slot-mode antenna units in an endfire mode.

21 Claims, 11 Drawing Sheets

U.S. PATENT DOCUMENTS

| | | | | |
|---|---|---|---|---|
| 4,173,019 | A | 10/1979 | Williams | 343/700 |
| 4,287,603 | A | 9/1981 | Moser | 455/293 |
| 4,297,706 | A | 10/1981 | Nikolayuk | 343/771 |
| 4,546,358 | A | 10/1985 | Edlin et al. | 343/703 |
| 4,734,660 | A | 3/1988 | Lofgren | 333/21 |
| 5,389,937 | A | 2/1995 | Kaloi | 343/700 |
| 5,477,233 | A | 12/1995 | Hemming et al. | 343/767 |
| 5,485,167 | A | 1/1996 | Wong et al. | 343/753 |
| 5,635,945 | A * | 6/1997 | McConnell et al. | 343/895 |
| 5,838,285 | A * | 11/1998 | Tay et al. | 343/895 |
| 6,384,798 | B1 * | 5/2002 | Barta et al. | 343/895 |
| 6,512,487 | B1 | 1/2003 | Taylor et al. | 343/795 |
| 6,512,497 | B1 | 1/2003 | Kondo et al. | 345/1.1 |
| 7,173,566 | B2 | 2/2007 | Cheng | 343/700 |
| 7,420,519 | B2 * | 9/2008 | Durham et al. | 343/770 |
| 2005/0099353 | A1 | 5/2005 | Jones et al. | 343/795 |
| 2005/0237267 | A1 | 10/2005 | Brown et al. | 343/909 |
| 2007/0139272 | A1 | 6/2007 | Durham et al. | 343/700 |
| 2007/0139274 | A1 | 6/2007 | Durham et al. | 343/700 |

* cited by examiner

TUBULAR ENDFIRE SLOT-MODE ANTENNA ARRAY WITH INTER-ELEMENT COUPLING AND ASSOCIATED METHODS

CROSS-REFERENCE TO RELATED APPLICATIONS

This application is a continuation-in-part of application Ser. No. 11/303,338 filed Dec. 16, 2005, now U.S. Pat. No. 7,420,519 the entire disclosure of which is incorporated herein by reference.

FIELD OF THE INVENTION

The present invention relates to the field of communications, and, more particularly, to low profile phased array antennas and related methods.

BACKGROUND OF THE INVENTION

Existing microwave antennas include a wide variety of configurations for various applications, such as satellite reception, remote broadcasting, or military communication. The desirable characteristics of low cost, light-weight, low profile and mass producibility are provided in general by printed circuit antennas. The simplest forms of printed circuit antennas are microstrip antennas wherein flat conductive elements are spaced from a single essentially continuous ground element by a dielectric sheet of uniform thickness. An example of a microstrip antenna is disclosed in U.S. Pat. No. 3,995,277 to Olyphant.

The antennas are designed in an array and may be used for communication systems such as identification of friend/foe (IFF) systems, personal communication service (PCS) systems, satellite communication systems, and aerospace systems, which require such characteristics as low cost, light weight, low profile, and low sidelobes.

The bandwidth and directivity capabilities of such antennas, however, can be limiting for certain applications. While the use of electromagnetically coupled microstrip patch pairs can increase bandwidth, obtaining this benefit presents significant design challenges, particularly where maintenance of a low profile and broad beam width is desirable. Also, the use of an array of microstrip patches can improve directivity by providing a predetermined scan angle. However, utilizing an array of microstrip patches presents a dilemma. The scan angle can be increased if the array elements are spaced closer together, but closer spacing can increase undesirable coupling between antenna elements thereby degrading performance.

Furthermore, while a microstrip patch antenna is advantageous in applications requiring a conformal configuration, e.g. in aerospace systems, mounting the antenna presents challenges with respect to the manner in which it is fed such that conformality and satisfactory radiation coverage and directivity are maintained and losses to surrounding surfaces are reduced. More specifically, increasing the bandwidth of a phased array antenna with a wide scan angle is conventionally achieved by dividing the frequency range into multiple bands.

One example of such an antenna is disclosed in U.S. Pat. No. 5,485,167 to Wong et al. This antenna includes several pairs of dipole pair arrays each tuned to a different frequency band and stacked relative to each other along the transmission/reception direction. The highest frequency array is in front of the next lowest frequency array and so forth.

This approach may result in a considerable increase in the size and weight of the antenna while creating a Radio Frequency (RF) interface problem. Another approach is to use gimbals to mechanically obtain the required scan angle. Yet, here again, this approach may increase the size and weight of the antenna and result in a slower response time.

Harris Current Sheet Array (CSA) technology represents the state of the art in broadband, low profile antenna technology. For example, U.S. Pat. No. 6,512,487 to Taylor et al. is directed to a phased array antenna with a wide frequency bandwidth and a wide scan angle by utilizing tightly packed dipole antenna elements with large mutual capacitive coupling. The antenna of Taylor et al. makes use of, and increases, mutual coupling between the closely spaced dipole antenna elements to prevent grating lobes and achieve the wide bandwidth.

A slot version of the CSA has many advantages over the dipole version including the ability to produce vertical polarization at horizon, metal aperture coincident with external ground plane, reduced scattering, and stable phase center at aperture. Conformal aircraft antennas frequently require a slot type pattern, but the dipole CSA does not address these applications. Analysis and measurements have shown that the dipole CSA cannot meet requirements for vertical polarized energy at the horizon. The Dipole CSA is also limited in wide angle scan performance due to dipole-like element pattern over a ground plane.

A general implementation of a phased array may be capable of focusing the energy from all antenna elements to any desired point in space. Phased array antennas may typically have the elements arranged in a rectangular grid and be capable of focusing the antenna array pattern from broadside to the array to angles nearing 50 degrees off of broadside without difficulty. Scanning the array to angles exceeding 50 degrees becomes increasingly more difficult. In some applications, however, it may be desirable to operate an array in an endfire mode, which directs the radiation along the axis of the array at a scan angle of 0 degrees, corresponding to 90 degrees from broadside.

Endfire operation is a difficult mode in which to use a phased array. An antenna array's ability to scan to angles approaching endfire may include several problems, and traditional designs of antenna arrays used to scan in the endfire direction may need specialized antenna elements with limited fields-of-view (FOV). Furthermore, there may be a need for a broadband conformal endfire array that can be applied to a specific structure such as a tube or cylinder.

SUMMARY OF THE INVENTION

In view of the foregoing background, it is therefore an object of the present invention to provide a tubular antenna that can operate in endfire mode over a broad bandwidth.

This and other objects, features, and advantages in accordance with the present invention are provided by a tubular slot-mode antenna including a tubular substrate, and an array of slot-mode antenna units carried by the tubular substrate. Each slot-mode antenna unit includes a pair of patch antenna elements arranged in laterally spaced apart relation about at least one central feed position, and adjacent patch antenna elements of adjacent slot-mode antenna units have respective spaced apart edge portions with predetermined shapes and relative positioning to provide increased capacitive coupling therebetween.

The tubular substrate may define an axis, and the array of slot-mode antenna units may define a plurality of ring-shaped slots coaxial with the axis of the tubular substrate. The tubular substrate may define an interior, and a feed arrangement may be coupled to the array of slot-mode antenna units from within the interior of the tubular substrate. The feed arrangement may be coupled to the array of slot-mode antenna units to operate in an endfire mode.

The tubular substrate may be flexible and a rigid tubular body may mount the tubular substrate. The respective spaced apart edge portions may be interdigitated to provide the increased capacitive coupling therebetween. The substrate may comprise a ground plane and a dielectric layer adjacent thereto, and the pair of patch antenna elements may be arranged on the dielectric layer opposite the ground plane and define respective slots therebetween.

A method aspect is directed to a method of making a tubular slot-mode antenna including forming an array of slot-mode antenna units carried by a tubular substrate, each slot-mode antenna unit comprising a pair of patch antenna elements arranged on the tubular substrate in laterally spaced apart relation about a central feed position. The method includes shaping and positioning respective spaced apart edge portions of adjacent patch antenna elements of adjacent slot-mode antenna units on the tubular substrate to provide increased capacitive coupling therebetween.

The tubular substrate may define an axis, and forming the array of slot-mode antenna units may include defining a plurality of ring-shaped slots coaxial with the axis of the tubular substrate. The tubular substrate may define an interior, and the method also includes coupling a feed arrangement to the array of slot-mode antenna units from within the interior of the tubular substrate. Furthermore, the method may include mounting the tubular substrate on a rigid tubular body and/or coupling a feed arrangement to the array of slot-mode antenna units to operate in an endfire mode.

The tubular slot-mode antenna is capable of being mounted on a tubular surface such as a fuselage or nosecone of an aircraft, for example. Analysis and/or measurements have shown that the tubular slot-mode antenna can produce positive endfire gain over a broad bandwidth.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
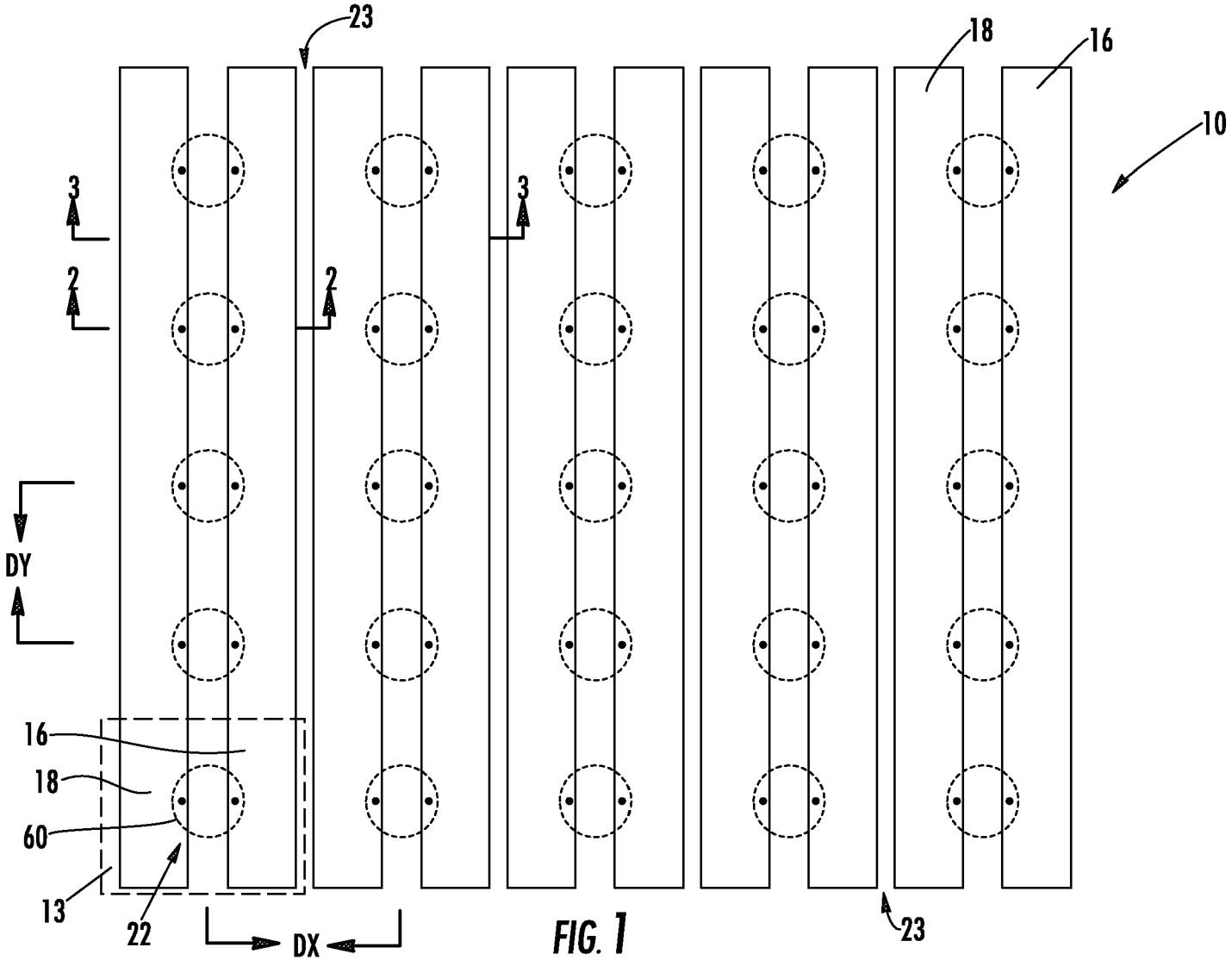
FIG. 1 is a schematic plan view of a single-polarization, slot antenna array in accordance with the present invention.

Referring to FIGS. 1-4, a single polarization, slot antenna array 10 according to the invention will now be described. The antenna 10 includes a substrate 12 having a ground plane 26 and a dielectric layer 24 adjacent thereto, and at least one antenna unit 13 carried by the substrate. Preferably, a plurality of antenna units 13 are arranged in an array. As shown in FIG. 1, the antenna 10, for example, includes a five-by-five array of twenty-five antenna units 13. Each antenna unit 13 includes two adjacent antenna patches or elements 16, 18, arranged in spaced apart relation from one another about a central feed position 22 on the dielectric layer 24 opposite the ground plane 26. Preferably, the pairs of antenna elements 16/18, are fed with 0/180° phase across their respective gaps to excite a slot mode. The phasing of the element excitations also provides a single polarization slot mode, as would be appreciated by the skilled artisan.

Figure 2:
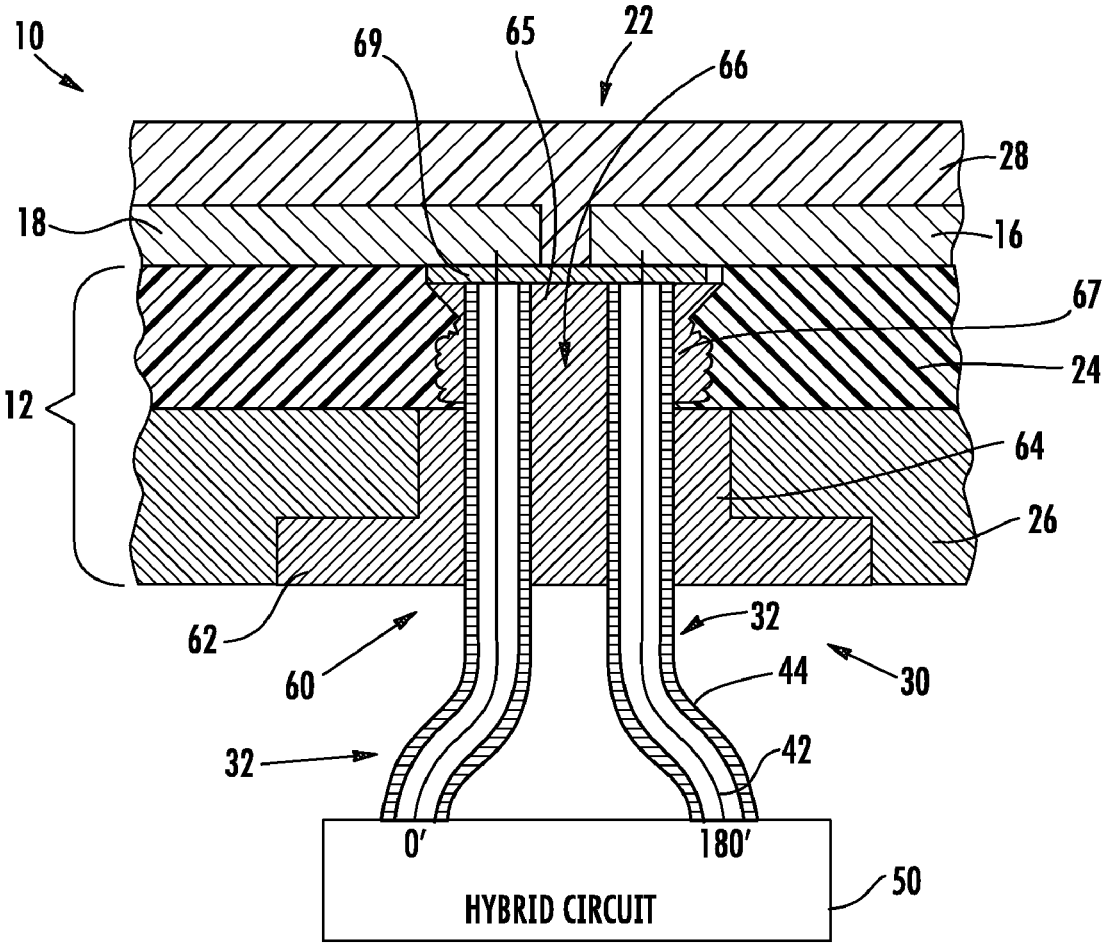
FIG. 2 is a cross-sectional view of the antenna including the antenna feed structure taken along the line 2-2 in FIG. 1.

Each antenna unit may also include an antenna feed structure 30 including two coaxial feed lines 32. Each coaxial feed line 32 has an inner conductor 42 and a tubular outer conductor 44 in surrounding relation thereto, for example (FIG. 2). The antenna feed structure 30 includes a feed line organizer body 60 having passageways therein for receiving respective coaxial feed lines 32. The feed line organizer 60 is preferably integrally formed as a monolithic unit, as will be appreciated by those of skill in the art.

More specifically, the feed line organizer body 60 may include a base 62 connected to the ground plane 26. A bottom enclosed guide portion 64 may be carried by the base 62, a top enclosed guide portion 65 is adjacent the antenna elements 16, 18 and an intermediate open guide portion 66 extends between the bottom enclosed guide portion and the top enclosed guide portion. The outer conductor 44 of each coaxial feed line 32 may be connected to the feed line organizer body 60 at the intermediate open guide portion 66 via solder 67, as illustratively shown in FIG. 2.

The feed line organizer body 60 is preferably made from a conductive material, such as brass, for example, which allows for relatively easy production and machining thereof. As a result, the antenna feed structure 30 may be produced in large quantities to provide consistent and reliable ground plane 26 connection. Of course, other suitable materials may also be used for the feed line organizer body 60, as will be appreciated by those of skill in the art.

Additionally, as illustratively shown in FIG. 2, the coaxial feed lines 32 are parallel and adjacent to one another. Furthermore, the antenna feed structure 30 may advantageously include a tuning plate 69 carried by the top enclosed guide portion 65. The tuning plate 69 may be used to compensate for feed inductance, as will be appreciated by those of skill in the art.

More specifically, the feed line organizer body 60 allows the antenna feed structure 30 to essentially be "plugged in" to the substrate 12 for relatively easy connection to the antenna unit 13. The antenna feed structure 30 including the feed line organizer body 60 also allows for relatively easy removal and/or replacement without damage to the antenna 10. Moreover, common mode currents, which may result from improper grounding of the coaxial feed lines 32 may be substantially reduced using the antenna feed structure 30 including the feed line organizer body 60. That is, the intermediate open guide portion 66 thereof allows for consistent and reliable grounding of the coaxial feed lines 32.

The ground plane 26 may extend laterally outwardly beyond a periphery of the antenna units 13, and the coaxial feed lines 32 may diverge outwardly from contact with one another upstream from the central feed position 22, as can be seen in FIG. 2. The antenna 10 may also include at least one hybrid circuit 50 carried by the substrate 12 and connected to the antenna feed structure 30. The hybrid circuit 50 controls, receives and generates the signals to respective antenna elements 16, 18 of the antenna units 13, as would be appreciated by those skilled in the art.

The dielectric layer 24 preferably has a thickness in a range of about ½ an operating wavelength near the top of the operating frequency band of the antenna 10, and at least one upper or impedance matching dielectric layer 28 may be provided to cover the antenna units 13. This impedance matching dielectric layer 28 may also extend laterally outwardly beyond a periphery of the antenna units 13. The substrate 12 is flexible and can be conformally mounted to a rigid surface, such as the nose-cone of an aircraft or spacecraft, for example.

Figure 4A:
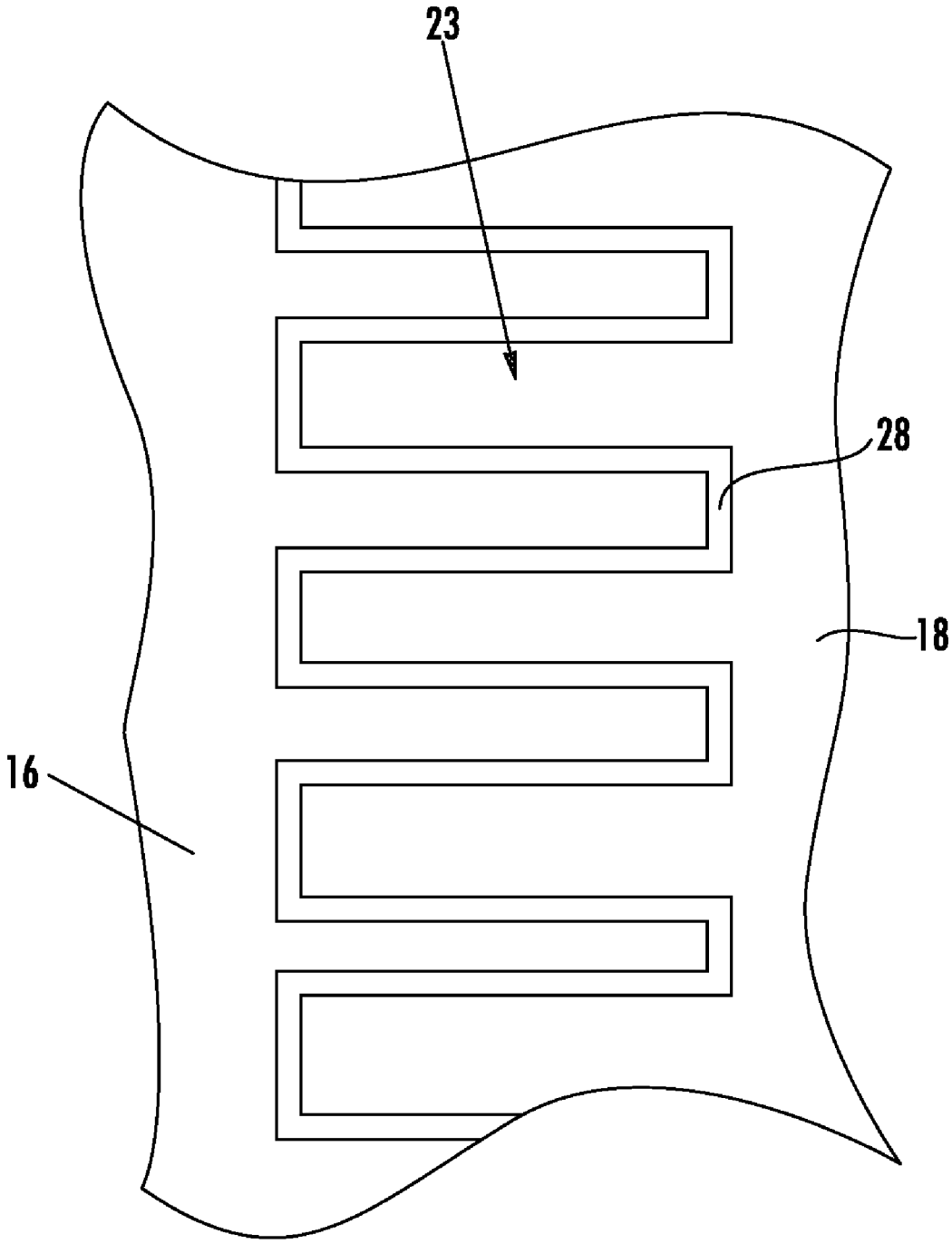
FIGS. 4A and 4B are enlarged views of respective embodiments of the interdigitated spaced apart edge portions of adjacent antenna elements of adjacent antenna units in the antenna array of FIG. 1.
Figure 4B:
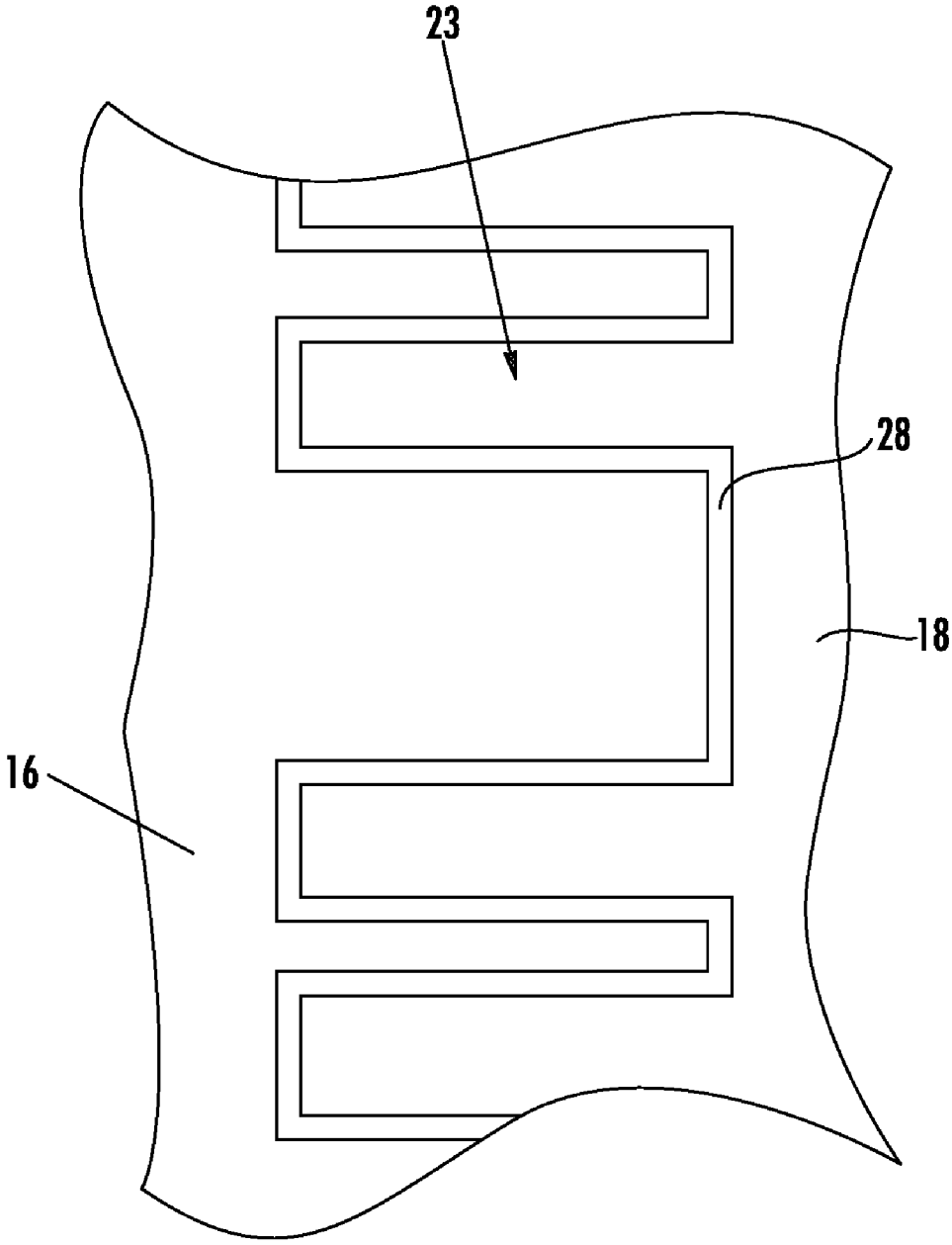

Referring more specifically to FIGS. 1, 4A and 4B, adjacent patch antenna elements 16, 18 of adjacent slot-mode antenna units 13 include respective spaced apart edge portions 23 having predetermined shapes and relative positioning to provide increased capacitive coupling therebetween. The respective spaced apart edge portions 23 may be interdigitated, as shown in the enlarged views of FIGS. 4A and 4B, to provide the increased capacitive coupling therebetween. As such, the spaced apart edge portions 23 may be continuously interdigitated along the edge portions (FIG. 4A) or periodically interdigitated along the edge portions (FIG. 4B).

Figure 7:
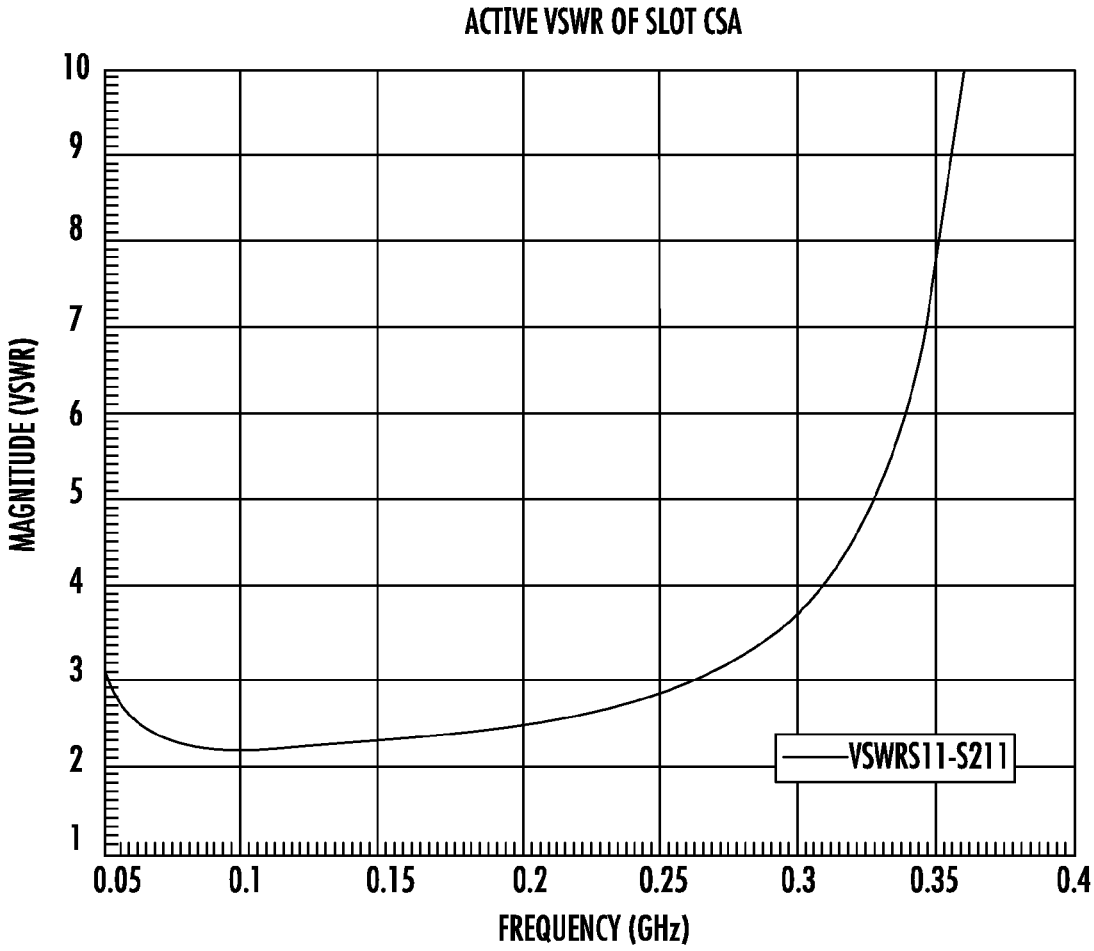
FIG. 7 is a graph illustrating the relative VSWR to frequency of the single-polarization, slot antenna array of the present invention.

The relative Voltage Standing Wave Ratio (VSWR) to frequency of the single-polarization, slot antenna array 10 of the present invention is illustrated in the graph of FIG. 7.

Thus, an antenna array 10 with a wide frequency bandwidth and a wide scan angle is obtained by utilizing the antenna elements 16, 18 of each slot-mode antenna unit 13 having mutual capacitive coupling with the antenna elements 16, 18 of an adjacent slot-mode antenna unit 13. Conventional approaches have sought to reduce mutual coupling between elements, but the present invention makes use of, and increases, mutual coupling between the closely spaced antenna elements to achieve the wide bandwidth.

A related method aspect of the invention is for making a single-polarization, slot antenna 10 including forming an array of slot-mode, antenna units 13 carried by a substrate 12, each single-polarization, slot antenna unit comprising four patch antenna elements 16, 18 arranged in laterally spaced apart relation about a central feed position 22. The method includes shaping and positioning respective spaced apart edge portions 23 of adjacent patch antenna elements of adjacent single-polarization, slot antenna units 13 to provide increased capacitive coupling therebetween.

Shaping and positioning may include continuously or periodically interdigitating the respective spaced apart edge portions 23, as shown in the enlarged views of FIGS. 4A and 4B. Again, the substrate 12 may be flexible and comprise a ground plane 26 and a dielectric layer 24 adjacent thereto, and forming the array comprises arranging the pair of patch antenna elements 16, 18 on the dielectric layer opposite the ground plane to define respective slots therebetween.

The method may further include forming an antenna feed structure 30 for each antenna unit and comprising two coaxial feed lines 32, each coaxial feed line comprising an inner conductor 42 and a tubular outer conductor 44 in surrounding relation thereto. The outer conductors 44 are connected to the ground plane 26, and the inner conductors 42 extend outwardly from ends of respective outer conductors, through the dielectric layer 24 and are connected to respective patch antenna elements at the central feed position 22, for example, as shown in FIG. 2.

Figure 5:
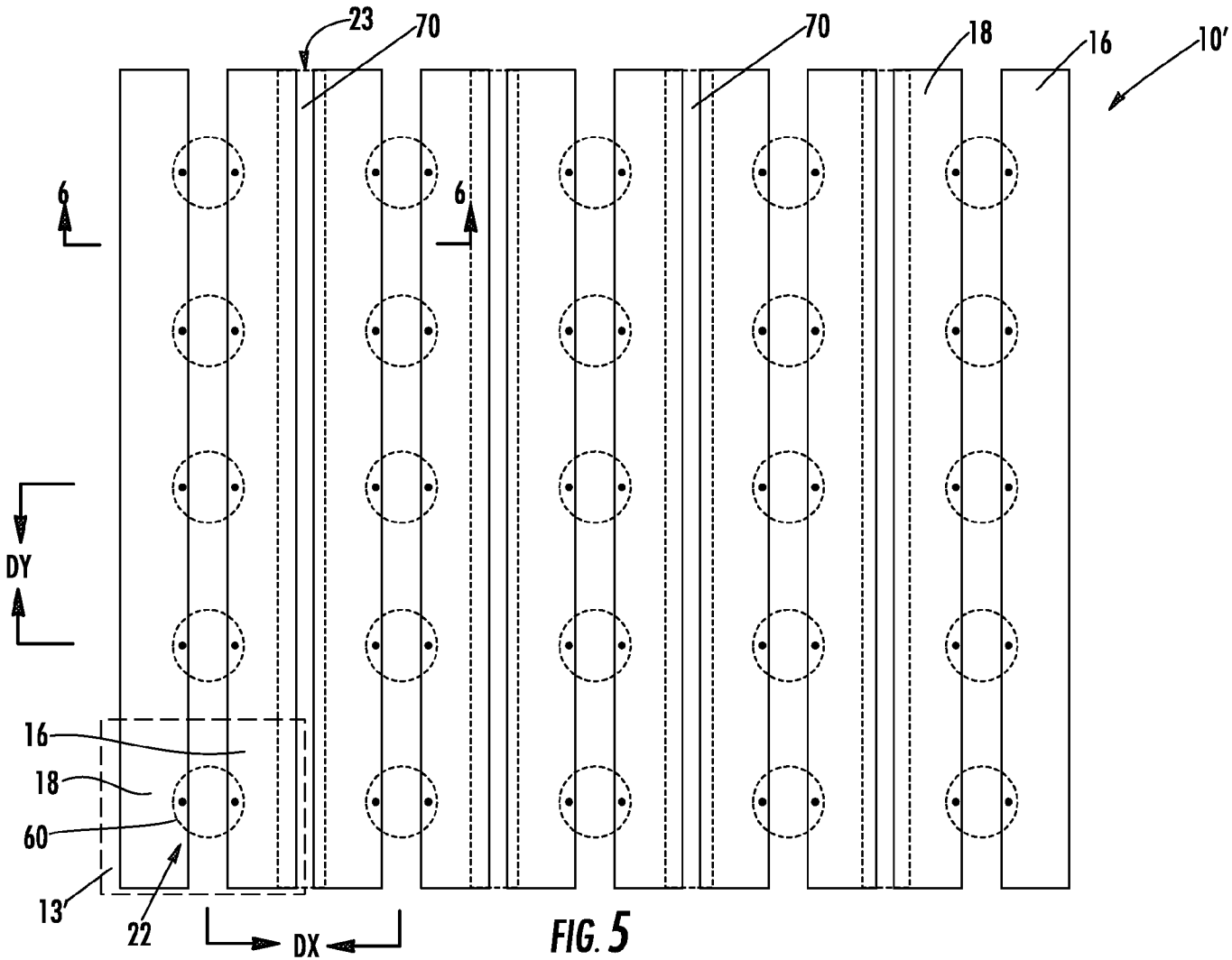
FIG. 5 is a schematic plan view of another embodiment of the single-polarization, slot antenna array in accordance with the present invention.
Figure 6A:
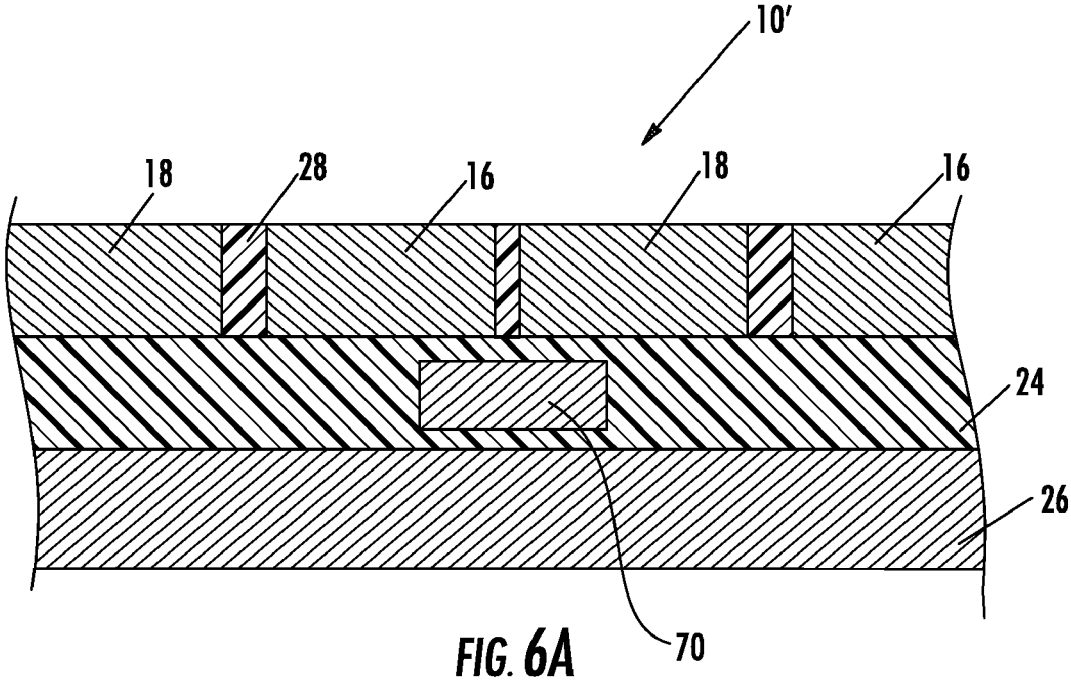
FIG. 6A is a cross-sectional view of the ground plane, dielectric layer, antenna units and capacitive coupling plates of the antenna taken along the line 6-6 in FIG. 5.
Figure 6B:
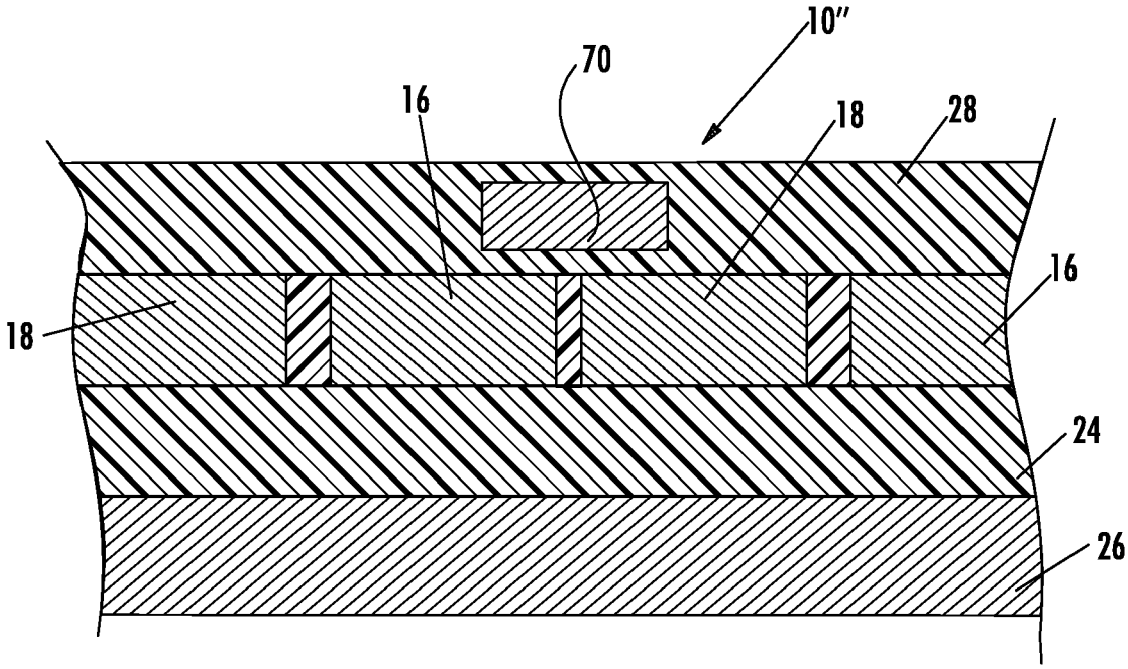
FIG. 6B is a cross-sectional view of another embodiment with the capacitive coupling plates in an upper dielectric layer of the antenna of FIG. 5.

Referring now to FIGS. 5, 6A and 6B, another embodiment of a single polarization slot mode antenna 10' will now be described. Adjacent patch antenna elements 16, 18 of adjacent slot-mode antenna units 13' have respective spaced apart edge portions 23 defining gaps therebetween. A capacitive coupling layer or plates 70 are adjacent the gaps and overlap the respective spaced apart edge portions 23 to provide the increased capacitive coupling therebetween. The capacitive coupling plates 70 may be arranged within the dielectric layer 24 (FIG. 6A) below the patch antenna elements or within the second dielectric layer 28 above the patch antenna elements plane (FIG. 6B).

Thus, an antenna array 10' with a wide frequency bandwidth and a wide scan angle is obtained by utilizing the antenna elements 16, 18 of each slot-mode antenna unit 13' having mutual capacitive coupling with the antenna elements 16, 18 of an adjacent slot-mode antenna unit 13'.

A method aspect of this embodiment of the invention is directed to making a slot-mode antenna 10' and includes providing a respective capacitive coupling plate 70 adjacent each gap and overlapping the respective spaced apart edge portions 23 to provide the increased capacitive coupling therebetween. Again, the capacitive coupling plates 70 may be arranged within the dielectric layer 24 below the patch antenna elements or within the second dielectric layer 28 above the patch antenna elements.

The antenna 10, 10' may have a seven-to-one bandwidth for 2:1 VSWR, and may achieve a scan angle of +/−75 degrees. The antenna 10, 10' may have a greater than ten-to-one bandwidth for 3:1 VSWR. Thus, a lightweight patch array antenna 10, 10, according to the invention with a wide frequency bandwidth and a wide scan angle is provided. Also, the antenna 10, 10' is flexible and can be conformally mountable to a surface, such as an aircraft.

Figure 8:
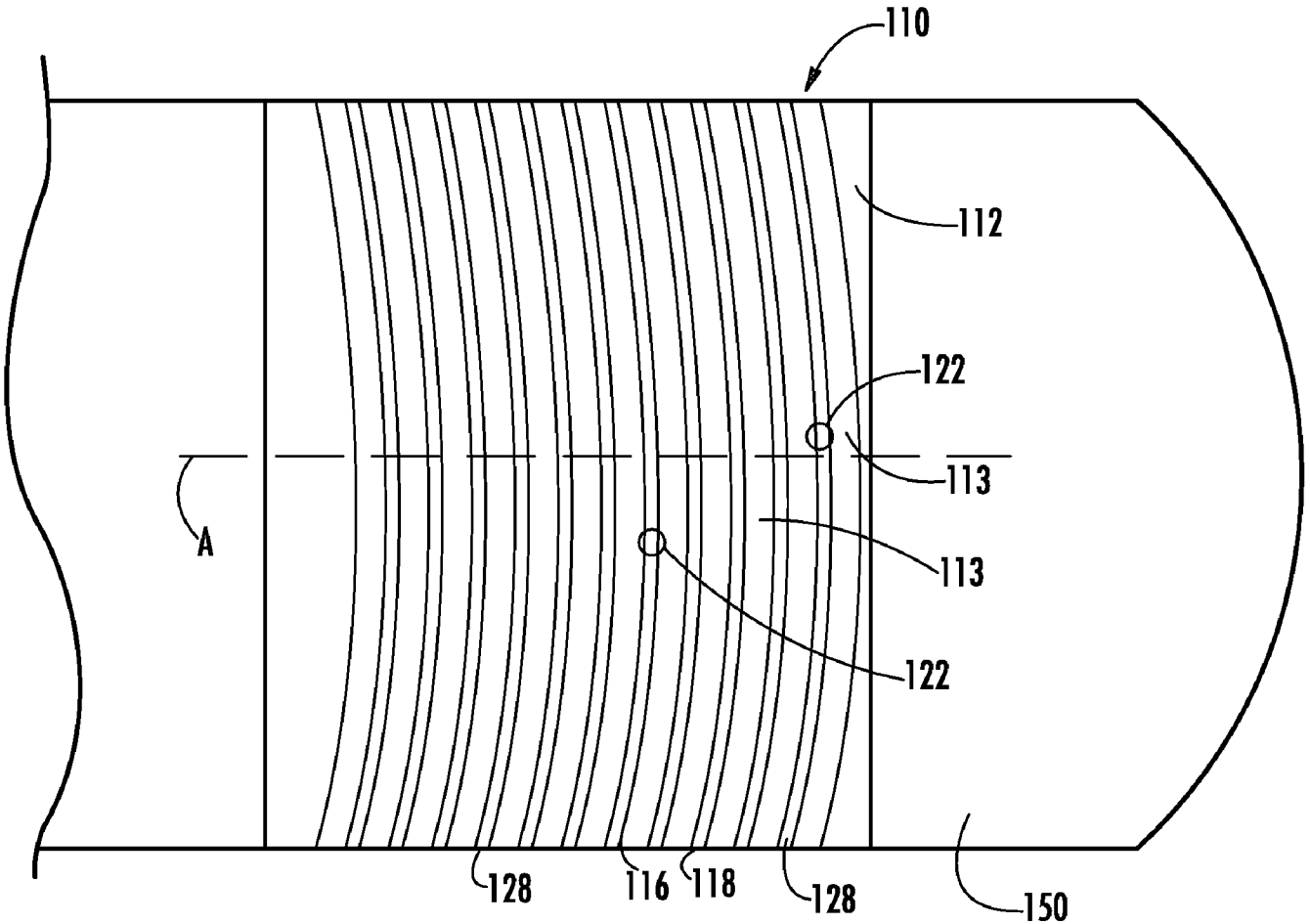
FIG. 8 is a schematic diagram of another embodiment of the slot-mode antenna array mounted on a tubular body according to the invention.
Figure 9:
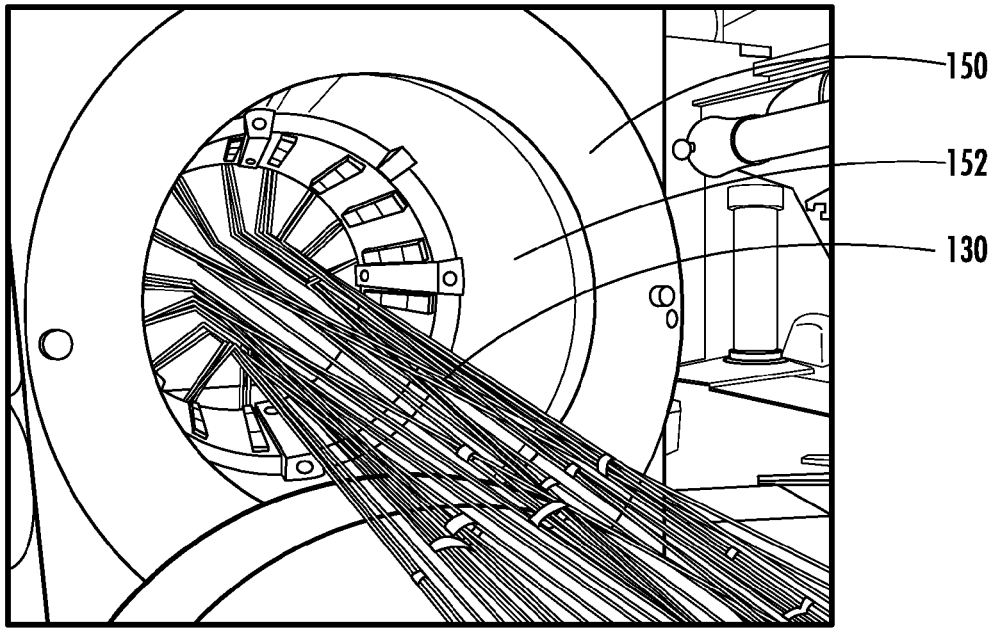
FIG. 9 is a perspective view of the interior of the tubular body of FIG. 8 including the feed arrangement therein.

Referring now to FIGS. 8 and 9, other embodiments of the slot-mode antenna array 110 will now be described. As discussed above, there may be a need for a broadband conformal endfire array that can be applied to a specific structure such as a tube or cylinder. In endfire mode, the radiation is directed along the axis of the array at or near a scan angle of 0 degrees, corresponding to 90 degrees from broadside.

Figure 3:
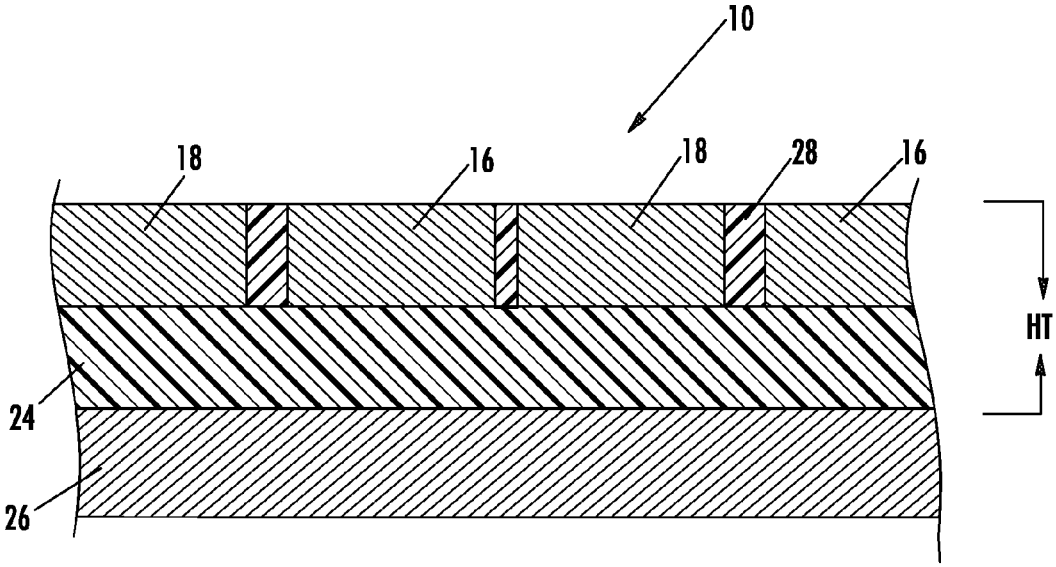
FIG. 3 is a cross-sectional view of the ground plane, dielectric layer, antenna units and upper dielectric layer of the antenna taken along the line 3-3 in FIG. 1.

The tubular slot-mode antenna array 110 includes a tubular substrate 112, and an array of slot-mode antenna units 113 carried by the tubular substrate. Illustratively, in FIGS. 8 and 9, the tubular substrate 112 is shown as a cylinder, but the tubular substrate may also define other closed geometrical cross-sections such as rectangular, trapezoidal or triangular cross-sections, for example. Each slot-mode antenna unit 113 includes a pair of patch antenna elements 116, 118 arranged in laterally spaced apart relation about at least one central feed position 122. Referring additionally to FIG. 3, the tubular substrate 112 may comprise a dielectric layer 24 and a ground plane 26 adjacent thereto, and the patch antenna elements 116, 118 may be arranged on the dielectric layer opposite the ground plane and define respective slots 128 therebetween.

As described above with respect to the embodiment of FIGS. 1-4, adjacent patch antenna elements 116, 118 of adjacent slot-mode antenna units 113 have respective spaced apart edge portions 23 with predetermined shapes and relative positioning to provide increased capacitive coupling therebetween. For example, as illustrated in FIGS. 4A and 4B, the respective spaced apart edge portions 23 may be interdigitated to provide the increased capacitive coupling therebetween.

Alternatively, as illustrated in the embodiment of FIGS. 5, 6A and 6B, a capacitive coupling layer or plates 70 may be adjacent the gaps and overlap the respective spaced apart edge portions 23 to provide the increased capacitive coupling therebetween.

As illustrated in FIG. 8, the tubular substrate 112 defines an axis A, and the array 110 of slot-mode antenna units define a plurality of ring-shaped slots 128 coaxial with the axis A of the tubular substrate 112. The tubular substrate 112 is flexible and a rigid tubular body 150 may mount the tubular substrate thereon. The tubular substrate 112 may define an interior 152 (FIG. 9), and a feed arrangement 130 may be coupled to the array 110 of slot-mode antenna units 113 from within the interior of the tubular substrate 112. The feed arrangement 130 may be coupled to the array 110 of slot-mode antenna units 113 to operate in an endfire mode, as discussed above.

Figure 10:
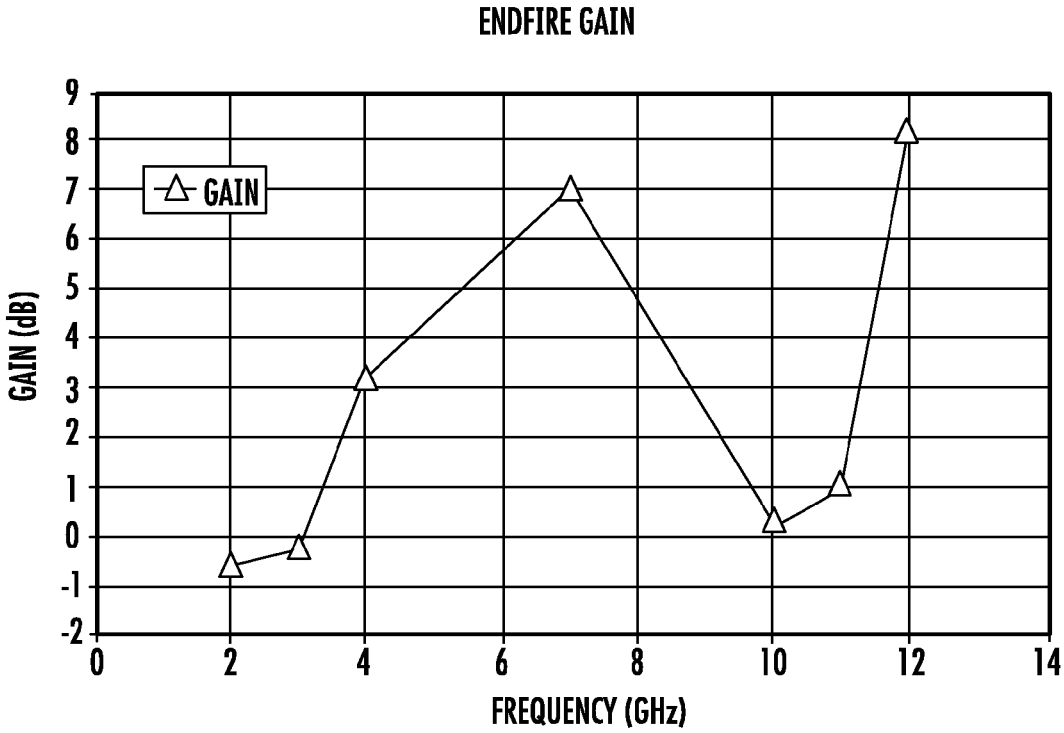
FIG. 10 is a plot of the endfire gain for an example of the tubular slot-mode antenna array of FIG. 8.

The tubular slot-mode antenna array 110 is capable of being mounted on a tubular surface or body 150, such as a fuselage or nosecone of an aircraft or a smaller diameter tubular body, for example. A plot of the predicted endfire gain for an example of the tubular slot-mode antenna array 110 is shown in FIG. 10. Analysis shows that the tubular slot-mode antenna array 110 can produce positive endfire gain over a broad bandwidth.

A method aspect of this embodiment is directed to a method of making a tubular slot-mode antenna array 110 including forming an array of slot-mode antenna units 113 carried by a tubular substrate 112, each slot-mode antenna unit 113 comprising a pair of patch antenna elements 116, 118 arranged on the tubular substrate 112 in laterally spaced apart relation about a central feed position 122. The method may include shaping and positioning respective spaced apart edge portions 23 (e.g. FIGS. 4A and 4B) of adjacent patch antenna elements 116, 118 of adjacent slot-mode antenna units 113 on the tubular substrate 112 to provide increased capacitive coupling therebetween. Also, the method may include providing a capacitive coupling layer or plates 70 (e.g. FIGS. 5, 6A and 6B) adjacent the gaps and overlapping the respective spaced apart edge portions 23 to provide the increased capacitive coupling therebetween.

Again, the tubular substrate 112 may define an axis A, and forming the array 110 of slot-mode antenna units 113 may include defining a plurality of ring-shaped slots 128 coaxial with the axis A of the tubular substrate 112. Furthermore, the method may include mounting the tubular substrate 112 on a rigid tubular body 150 which defines an interior 152, and the method also includes coupling a feed arrangement 130 to the array of slot-mode antenna units from within the interior 152 of the tubular substrate 112. The feed arrangement 130 is coupled to the array of slot-mode antenna units to operate in an endfire mode.

The disclosure of related application entitled "TUBULAR ENDFIRE SLOT-MODE ANTENNA ARRAY WITH INTER-ELEMENT COUPLING PLATES AND ASSOCIATED METHODS" to the same assignee and concurrently filed herewith is incorporated by reference herein in its entirety.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A tubular slot-mode antenna comprising:

a tubular substrate; and an array of slot-mode antenna units carried by said tubular substrate;

each slot-mode antenna unit comprising a pair of patch antenna elements arranged in laterally spaced apart relation about at least one central feed position;

adjacent patch antenna elements of adjacent slot-mode antenna units comprising respective spaced apart edge portions having predetermined shapes and relative positioning to provide increased capacitive coupling therebetween.

2. The tubular slot-mode antenna according to claim 1 wherein said tubular substrate defines an axis; and wherein the array of slot-mode antenna units defines a plurality of ring-shaped slots coaxial with the axis of said tubular substrate.

3. The tubular slot-mode antenna according to claim 1 wherein said tubular substrate defines an interior; and further comprising a feed arrangement coupled to said array of slot-mode antenna units from within the interior of said tubular substrate.

4. The tubular slot-mode antenna according to claim 1 further comprising a feed arrangement coupled to said array of slot-mode antenna units to operate in an endfire mode.

5. The tubular slot-mode antenna according to claim 1 further comprising a rigid tubular body mounting said tubular substrate.

6. The tubular slot-mode antenna according to claim 1 wherein respective spaced apart edge portions are interdigitated to provide the increased capacitive coupling therebetween.

7. The tubular slot-mode antenna according to claim 1 wherein said substrate comprises a ground plane and a dielectric layer adjacent thereto; and wherein the pair of patch antenna elements are arranged on said dielectric layer opposite said ground plane and define respective slots therebetween.

8. The tubular slot-mode antenna according to claim 1 wherein said tubular substrate is flexible.

9. A cylindrical slot-mode antenna comprising:

a cylindrical substrate comprising a ground plane and a dielectric layer adjacent thereto, said cylindrical substrate defines an interior;

an array of slot-mode antenna units carried by said substrate;

each slot-mode antenna unit comprising a pair of patch antenna elements arranged in laterally spaced apart relation about a central feed position and on said dielectric layer opposite said ground plane;

adjacent patch antenna elements of adjacent slot-mode antenna units comprising respective spaced apart interdigitated edge portions to provide increased capacitive coupling therebetween; and a feed arrangement coupled to said array of slot-mode antenna units from within the interior of said cylindrical substrate to operate said array of slot-mode antenna units in an endfire mode.

10. The cylindrical slot-mode antenna according to claim 9 wherein said cylindrical substrate defines an axis; and wherein the array of slot-mode antenna units defines a plurality of ring-shaped slots coaxial with the axis of said cylindrical substrate.

11. The cylindrical slot-mode antenna according to claim 9 further comprising a rigid cylindrical body mounting said cylindrical substrate.

12. The cylindrical slot-mode antenna according to claim 9 wherein respective spaced apart edge portions are interdigitated to provide the increased capacitive coupling therebetween.

13. The cylindrical slot-mode antenna according to claim 9 wherein said cylindrical substrate is flexible.

14. A method of making a tubular slot-mode antenna comprising:

forming an array of slot-mode, antenna units carried by a tubular substrate, each slot-mode antenna unit comprising a pair of patch antenna elements arranged on the tubular substrate in laterally spaced apart relation about a central feed position; and shaping and positioning respective spaced apart edge portions of adjacent patch antenna elements of adjacent slot-mode antenna units on the tubular substrate to provide increased capacitive coupling therebetween.

15. The method according to claim 14 wherein the tubular substrate defines an axis; and wherein forming the array of slot-mode antenna units includes defining a plurality of ring-shaped slots coaxial with the axis of the tubular substrate.

16. The method according to claim 14 wherein the tubular substrate defines an interior; and further comprising coupling a feed arrangement to the array of slot-mode antenna units from within the interior of the tubular substrate.

17. The method according to claim 14 further comprising coupling a feed arrangement to the array of slot-mode antenna units to operate in an endfire mode.

18. The method according to claim 14 further comprising mounting the tubular substrate on a rigid tubular body.

19. The method according to claim 14 wherein shaping and positioning comprises interdigitating the respective spaced apart edge portions.

20. The method according to claim 14 wherein the tubular substrate comprises a ground plane and a dielectric layer adjacent thereto; and wherein forming the array comprises arranging the pair of patch antenna elements on the dielectric layer opposite the ground plane to define respective slots therebetween.

21. The method according to claim 14 wherein the tubular substrate is flexible.

* * * * *